United States Patent [19]

Kato

[11] 4,385,609

[45] May 31, 1983

[54] FUEL INJECTION SYSTEM FOR INTERNAL COMBUSTION ENGINES

[75] Inventor: Masaaki Kato, Kariya, Japan

[73] Assignee: Nippondenso Co., Ltd., Kariya, Japan

[21] Appl. No.: 264,698

[22] Filed: May 18, 1981

[30] Foreign Application Priority Data

May 30, 1980 [JP] Japan ..... 55-71329

[51] Int. Cl.[3] ..... F02M 57/02

[52] U.S. Cl. ..... 123/446; 239/88

[58] Field of Search ..... 123/500, 446, 495, 472; 239/88-91

[56] References Cited

U.S. PATENT DOCUMENTS

| | | | |
|---|---|---|---|
| 2,950,709 | 8/1960 | Bessiere | 123/446 |
| 3,961,612 | 6/1976 | Okamoto et al. | 123/446 |
| 4,170,974 | 10/1979 | Kopse et al. | 123/445 |
| 4,219,154 | 8/1980 | Luscomb | 123/472 |
| 4,222,358 | 9/1980 | Hofbauer | 123/495 |
| 4,279,385 | 7/1981 | Straubel et al. | 139/90 |
| 4,297,982 | 11/1981 | Lakra | 123/446 |

*Primary Examiner*—Ira S. Lazarus
*Assistant Examiner*—Magdalen Moy
*Attorney, Agent, or Firm*—Cushman, Darby & Cushman

[57] ABSTRACT

A unit injector type of fuel injection system comprising a delivery cylinder with a delivery plunger slidable therein and defining a delivery pump chamber, an injection cylinder with an injection plunger slidable therein and defining an injection pump chamber, first and second stops on opposite ends of the injection cylinder for limiting the axial movement of the injection plunger, the injection plunger being displaced by the fuel into the injection pump chamber, through a stroke corresponding to the amount of the fed fuel, and nozzle for injecting the fuel delivered by the injection pump chamber, the injection plunger being moved under the pressure which occurs in the delivery pump chamber due to the displacement of the delivery plunger.

5 Claims, 1 Drawing Figure

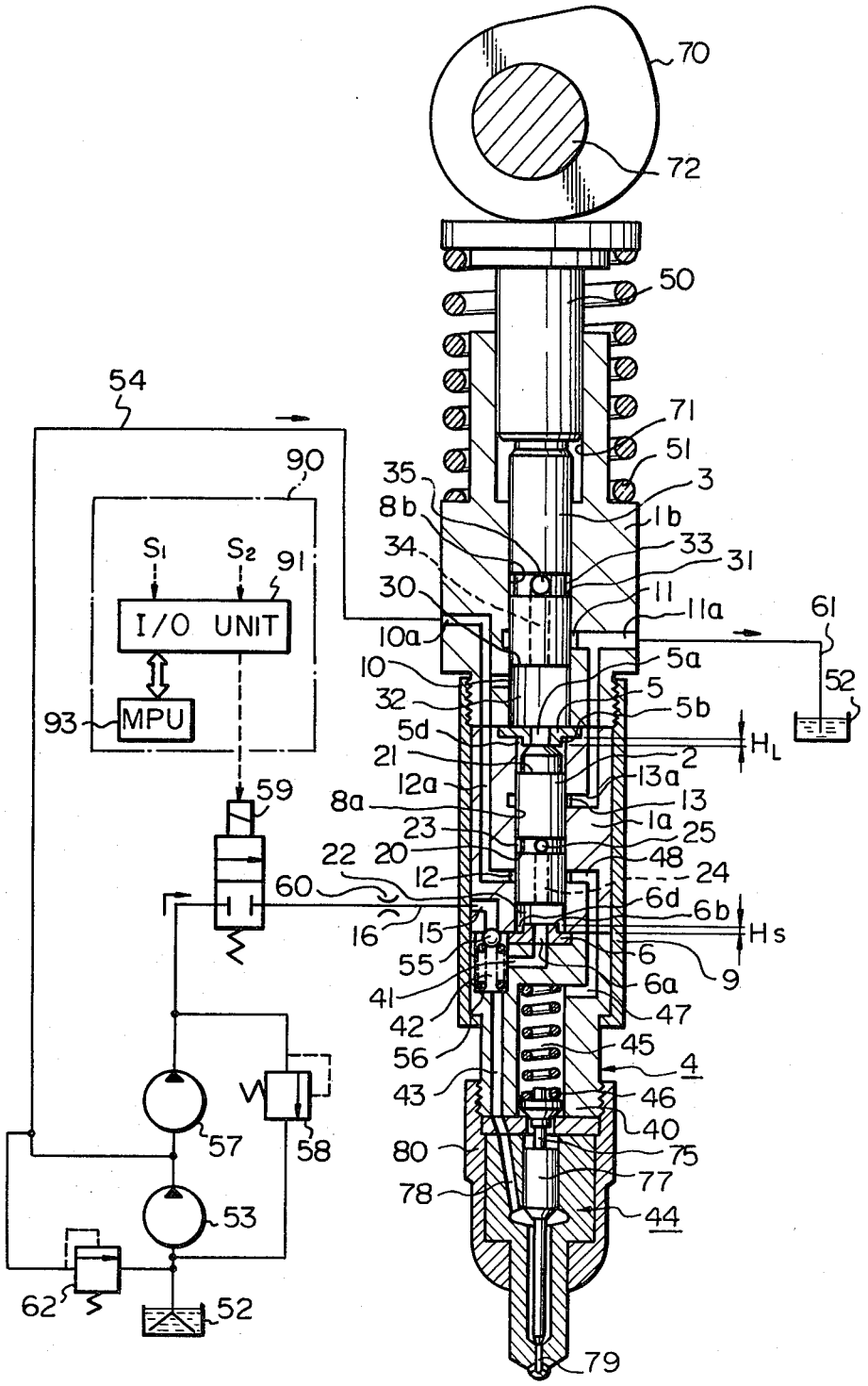
70
72
50
54
71
51
90
35
3
8b
1b
34
33
31
S1
S2
91
30
11
11a
61
I/O UNIT
10a
5a
10
5
52
32
5b
93
MPU
5d
HL
21
2
12a
13a
59
8a
13
23
1a
25
22
20
48
24
12
60
6d
6b
16
15
Hs
55
6
9
41
6a
42
47
56
45
4
43
46
40
57
58
80
75
77
78
44
53
62
52
79

FUEL INJECTION SYSTEM FOR INTERNAL COMBUSTION ENGINES

This invention relates to a fuel injection system for an internal combustion engine and in particular to a unit injector system for feeding fuel to a diesel engine.

There is known an orifice control type of fuel control system in a unit injector system. In this fuel control system, the amount of fuel to be fed, which is pressurized at a predetermined pressure is controlled by an inlet orifice, and, then, the fuel is fed into a pump chamber of a plunger pump. The plunger of the plunger pump is driven by the engine to inject the fuel into a combustion chamber of the engine.

However, in this type of fuel control system, since the plunger is always moved by a constant stroke, bubbles are produced in the pump chamber during a partial load of the engine, so that the amount of the fuel injected is unstable and an undesirable injection such as a secondary injection occurs.

The object of the present invention is to eliminate the drawbacks mentioned above by providing an engine driven fuel injection system in which a plunger of a plunger pump is displaced by a stroke corresponding to the amount of the fuel to be fed to prevent bubbles from being produced in the pump chamber, thus resulting in no occurrence of undesirable injections.

In the detailed description of the preferred embodiment of the invention presented below, reference is made to the accompanying drawing which shows a longitudinal sectional view of a fuel injection system according to the present invention.

In the illustrated embodiment of the present invention, a fuel injection system has an injection cylinder 1*a* having a cylinder bore 8*a* in which an injection plunger 2 is slidably fitted, and a delivery cylinder 1*b* having a cylinder bore 8*b* in which a delivery plunger 3 is slidably fitted. The two divided cylinders 1*a* and 1*b* form an injector body. The diameter of the delivery plunger 3 is larger than that of the injection plunger 2. A nozzle holder 4 is mounted onto the bottom of the injection cylinder 1*a*. Between the two cylinders 1*a* and 1*b* is provided a first stop 5 which is adapted to limit the upward movement of the injection plunger 2 in order to control the amount of fuel to be ejected. The delivery cylinder 1*b* is provided on its top, with a bore 71 in which a cam follower 50 is slidably inserted. The cam follower 50 is connected to the delivery plunger 3. A return spring 51 is arranged between the delivery cylinder 1*b* and the cam follower 50 to move the cam follower 50. A cam 70 which rotates with a cam shaft 72 synchronously driven by an engine (not shown) bears against the cam follower 50, so that when the cam 70 rotates, the cam follower 50 moves downwards. The cam follower 50 is returned upwards by the return spring 51.

The delivery plunger 3 has a metering lead 30 which is adapted to open and close a metering port 10 formed in the delivery cylinder 1*b* and a spill lead 31 which is adapted to open and close a spill port 11 formed in the delivery cylinder 1*b*. The delivery plunger 3 further has an axial hole 34 and a cross hole 35 connected to the axial hole 34. The axial hole 34 is connected to a delivery pump chamber 32 defined in the cylinder bore 8*b* below the delivery plunger 3 and the cross hole 35 is connected to a peripheral annular groove 33 provided on the periphery of the delivery plunger 3.

The fuel in a fuel tank 52 is pumped by a first fuel feed pump 53 which is driven by the engine (not shown) and is then fed into the delivery pump chamber 32 by means of a feed passage 54 and a passage 10*a* which is provided in the delivery cylinder 1*b* and which is connected to the metering port 10.

The injection plunger 2 has a spill lead 20 which is adapted to open and close a spill port 12 formed in the injection cylinder 1*a* and an escape lead 21 which is adapted to open and close a pressure escape port 13 formed in the injection cylinder 1*a*. Further, the injection plunger 2 has an axial hole 24 and a cross hole 25 connected to the axial hole 24. The axial hole 24 is connected to an injection pump chamber 22 defined in the cylinder bore 8*a* below the plunger 2 and the cross hole 25 is connected to a peripheral annular groove 23 formed on the periphery of the injection plunger 2. The spill port 12 is connected to the passage 10*a* by means of a fuel passage 12*a* formed in the injection cylinder 1*a*. The pressure escape port 13 is connected to the spill port 11 by means of a passage 13*a* formed in the injection cylinder 1*a* and by means of a passage 11*a* formed in the delivery cylinder 1*b*.

The injection pump chamber 22 is connected to a nozzle assembly 44 by means of a fuel passage 41 formed in a nozzle holder body 40 of the nozzle holder 4, a non-return valve chamber 42, and a fuel passage 43 formed in the nozzle holder body 40. A non-return valve (ball valve) 55 and a spring 56 are arranged in the non-return valve chamber 42.

The stop 5 which limits the maximum lift of the injection plunger 2 has an axial passage 5*a* connecting the top surface of the injection plunger 2 and the delivery pump chamber 32. Between the injection cylinder 1*a* and the nozzle holder 4 is provided a second stop (spill stop) 6 which is adapted to control a spill stroke of the injection plunger 2 and which has an axial passage 6*a* connecting the bottom surface of the injection plunger 2 and the fuel passage 41.

A part of the fuel fed from the first fuel feed pump 53 is further pressurized by a second fuel feed pump 57 driven by the engine (not shown). The pressure of the further pressurized fuel is controlled by a fuel pressure regulator 58 where the pressure is maintained at a constant value. The pressure controlled fuel is then fed into the injection pump chamber 22 by means of an electromagnetic control valve 59 which is controlled by a control circuit 90 so that it operates to open in response to signals $S_1$ and $S_2$ representing the engine load ($S_1$), engine speed ($S_2$) or the like, a balance orifice 60 which ensures the feed of an equal amount of fuel into the engine cylinders, a fuel passage 16 formed in the delivery cylinder 1*b*, a fuel passage 15 formed in the injection cylinder 1*a* and connected to the fuel passage 16, the non-return valve chamber 42 and a fuel passage 41 formed in the nozzle holder body 40 between the non-return valve chamber 42 and the injection pump chamber 22.

The control circuit 90 is per se known, which includes an input-output unit (I/O unit) 91 having various kinds of interface circuits (not shown) and a micro processor unit (MPU) 93 which has a memory (not shown) storing a predetermined program and which operates in accordance with the program.

The nozzle assembly 44 is per se known, which is composed of a needle valve 77 with a valve stem 75 which controls a nozzle port opening 79 from which the fuel is ejected. The valve stem 75 is biassed into a closed position of the needle valve 77 by a nozzle spring 46 which is arranged in a nozzle spring chamber 45 formed in the nozzle holder body 40. The nozzle spring chamber 45 is connected to the fuel passage 12*a* by means of a connecting passage 47 formed in the nozzle holder body 40.

The spill port 11 of the delivery cylinder 1*b* is connected to the fuel tank 52 by means of a passage 11*a* formed in the delivery cylinder 1*b* and a drain pipe 61. The injection cylinder 1*a* and the nozzle holder 4 are rigidly connected to the delivery cylinder 1*b* by means of a nut 9. The unit injector shown in FIG. 1 can be mounted to a cylinder head (not shown) of the associated engine in such a way that the front end of the nozzle assembly 44 extends into a combustion chamber (not shown) of the engine.

The nozzle assembly 44 is rigidly connected to the nozzle holder body 40 by means of a nut 80 which is screw-engaged on the nozzle holder body.

The unit injector according to the present invention operates as follows.

First, the fuel of which the amount corresponds to the amount to be ejected from the nozzle assembly is fed into the injection pump chamber 22 and the injection plunger 2 is in its initial upper position depending on the amount of fuel to be ejected. When the delivery plunger 3 is displaced downwards by the rotation of the cam 70, the metering port 10 is closed by the metering lead 30. When the metering port 10 is closed, the fuel in the delivery pump chamber 32 begins to be pressurized, so that the pressure acts on the injection plunger 2. Consequently, the injection plunger 2 is displaced downwards at a speed which is higher than the speed of the movement of the delivery plunger 3 by a value depending on the difference in the cross areas of the delivery plunger 3 and the injection plunger 2. That is, the injection plunger 2 moves at a higher speed than that of the delivery plunger 3. As a result of the movement of the injection plunger 2, the pressurized fuel in the injection pump chamber 22 is delivered into the nozzle assembly 44 by means of the fuel passage 41 in the nozzle holder body 40, the non-return valve chamber 42, and the fuel passage 43 in the nozzle holder body 40. The pressurized fuel delivered into a fuel passage 78 of the nozzle assembly 44 causes the needle valve 77 to move upwards, so that the fuel is ejected from the nozzle opening 79. As soon as the spill lead 20 of the injection plunger 2 causes the spill port 12 of the injection cylinder 1*a* to open, the pressurized fuel in the injection pump chamber 22 is discharged into the fuel passage 12*a* through the axial hole 24 and the cross hole 25, and the injection is completed. Further downward movement of the delivery plunger 3 causes the injection plunger 2 to move downwards by a small displacement until the escape lead 21 causes the pressure escape port 13 to open. When the pressure escape port 13 opens, the pressurized fuel in the delivery pump chamber 32 is discharged into the fuel passage 13*a* and the injection plunger 2 continues to move downward due to the inertia and the downward movement of the delivery plunger 3 until the injection plunger 2 comes into contact with a projecting end 6*b* of the spill stop 6. That is, the amount of spilled fuel can be varied by varying the spill stroke of the injection plunger 2 (i.e. a stroke from a position in which the spill lead 20 of the injection plunger 2 causes the spill port 12 to open, to a position in which the injection plunger 2 is in contact with the projecting end 6*b* of the spill stop 6) which depends on the axial height $H_S$ of the projecting end 6*b*. The height $H_S$ can be determined in accordance with the required amount of fuel to be ejected and the characteristics of injection. Around the projecting end 6*b* between the stop 6 and the injection cylinder 1*a* is provided a space 6*d* which is a closed space when the injection plunger 2 comes to its bottom dead point and which accordingly serves as an oil damper during the downward movement of the injection plunger 2. The space 6*d* also contributes to a decrease of the wear of the injection plunger 2 and of the stop 6, which wear would occur due to the collision of the injection plunger 2 and the stop 6. The delivery plunger 3 continues to move downwards after the injection plunger 2 stops, so that the spill lead 31 causes the spill port 11 to open. When the spill port 11 opens, the fuel in the delivery pump chamber 32 is discharged into the fuel tank 52, through the axial hole 34, the cross hole 33, the fuel passage 11*a* and the drain pipe 61. Consequently, the compression stroke of the delivery plunger 3 is completed. The delivery plunger 3 further moves slightly downwards until it reaches its bottom dead point.

The fuel delivered by the first fuel feed pump 53 from the fuel tank 52, is, on the other hand, fed into the spill port 12 through the fuel feed passage 54, the fuel passages 10*a* and 12*a* and is then fed into the injection pump chamber 22 through the cross hole 25 and the axial hole 24 of the injection plunger 2. Consequently, the injection plunger 2 moves upwards while discharging the fuel into the delivery pump chamber 32 and stops when the spill port 12 is closed by the spill lead 20. In this way, the fuel of which the amount corresponds to the constant spill stroke (i.e. the stroke from the closure of the spill port 12 by the spill lead 20 of the injection plunger 2 to the stoppage of the movement of the injection plunger 2 at its bottom dead point) is fed into the injection pump chamber 22 from the spill port 12, every time when the fuel is ejected from the nozzle assembly. After that, the electromagnetic valve 59 opens for a predetermined time, during which the fuel which is first pressurized by the second fuel feed pump 57 and which is then regulated by the fuel pressure regulator 58 is fed into the fuel passages 16 and 15 through the balacne orifice 60. The pressure regulated fuel fed into the fuel passage 15 causes the non-return valve 55 to open against the spring 56, so that the fuel is fed into the injection pump chamber 22 to move the injection plunger upwards by a displacement corresponding to the amount of fuel to be ejected.

As can be understood from the above discussion, since the amount of fuel to be ejected depends on the time during which the electromagnetic valve 59 opens, the amount of fuel is properly controlled in accordance with the load of the associated engine (if necessary, in accordance with the number of revolutions of the engine and/or the temperature of the coolant of the engine in addition to the engine load).

The maximum amount of fuel to be ejected is limited by the injection plunger 2 which comes into contact with the stop 5 to prevent the engine from overrunning. It should be noted that the maximum amount of fuel to be ejected can be adjusted by varying the axial height $H_L$ of a projecting end 5*b* of the stop 5. The projecting end 5*b* defines an oil damper space 5*d* therearound corresponding to the space 6*d*. The compression stroke of the delivery plunger 3 is slightly larger than the stroke necessary for obtaining the maximum amount of fuel to be fed.

When a predetermined amount of fuel is fed into the injection pump chamber 22, the delivery plunger 3 is moved upwards by the upward movement of the injection plunger 2. During the movement of the delivery plunger 3, the spill lead 31 first causes the spill port 11 to be closed and then the metering lead 30 causes the metering port 10 to open. During this movement of the delivery plunger 3, bubbles occur in the delivery pump chamber 32, since the air in the delivery pump chamber 32 is compressed. However, these bubbles are broken or disappear when the metering port 10 opens so that the fuel is fed into the delivery pump chamber 32 from the first fuel feed pump 53. Therefore, when the delivery plunger 3 stops at its top dead point, the delivery pump chamber 32 is filled with the fuel which contains no bubbles. Thus, the delivery plunger is prepared for the subsequent compression stroke.

The spill lead 20, the annular groove 23, the axial hole 24, and the cross hole 25, of the injection plunger 2, and the spill port 12 and the fuel passage 12*a*, of the injection cylinder 1*a* can be all dispensed with. In this case, the fuel injection is completed when the escape lead 21 of the injection plunger 2 causes the pressure escape port 13 to open.

Furthermore, the spill lead 31, the axial hole 34, the cross hole 35, and the annular groove 33, of the delivery plunger 3, and the spill port 11 of the delivery cylinder 1*b* can be also dispensed with. Accordingly, when the escape lead 21 of the injection plunger 2 causes the pressure escape port 13 to open, the fuel injection is completed and at the same time the compression stroke of the delivery plunger 3 is also completed. The amount of fuel is controlled when the delivery plunger 3 moves upwards, since the delivery plunger 3 does not have a spill lead.

In the illustrated embodiment mentioned above, the nozzle spring chamber 45 is connected to the fuel passage 12*a* by means of the connecting passage 47. Alternatively, it is also possible to connect the nozzle spring chamber 45 to the fuel passages 13*a* and 11*a* rather than to the fuel passage 12*a*, by means of the connecting passage 47 in order to connect the nozzle spring chamber 45 to the pressure escape port 13 and the spill port 11. In this modification, when the pressure escape lead 21 causes the pressure escape port 13 to open after the completion of the fuel injection, the pressure in the delivery pump chamber 32 acts on the nozzle spring chamber 45 by way of the fuel passage 13*a* and the connecting passage 47, and, accordingly, the needle valve 77 of the nozzle assembly 44 is urged into its closed position, thus resulting in the prevention of the occurrence of an undesirable secondary fuel injection.

Furthermore, according to the present invention, since the delivery plunger 3 which is located on the injection plunger 2 has a diameter larger than that of the injection plunger 2, the pressure in the injection pump chamber 22 becomes larger than the pressure in the delivery pump chamber 32 by a value corresponding to the difference in the cross sectional area between the two plungers. The delivery plunger 3 thus serves as a piston which can increase the pressure acting on the injection pump chamber 22.

It should be noted that two fuel feed pumps 53 and 57 are provided in the illustrated embodiment, but these pumps can be replaced by a single fuel feed pump which feeds the fuel to the two pump chambers 22 and 32.

Finally, according to the present invention, since the injection plunger is displaced by a stroke proportionally corresponding to the amount of the fed fuel, no bubble occurs in the injection pump chamber, resulting in the prevention of an undesirable injection, such as a secondary injection and in the prevention of the fluctuation of the amount of fuel to be ejected. The provision of the stop for limiting the amount of fuel to be ejected and the spill stop makes it possible to easily obtain a controlled optimum amount of ejected fuel and of spilled fuel, whereby the same fuel injector can be applied to various kinds of engines.

I claim:

1. A fuel injection system for an internal combustion engine, comprising:

a substantially cylindrical injector body having a delivery cylinder and an injection cylinder connected to the delivery cylinder, a delivery plunger which is slidably fitted in the delivery cylinder and which defines a delivery pump chamber in the delivery cylinder, an injection plunger which is slidably fitted in the injection cylinder and which defines an injection pump chamber in the injection cylinder, said injection plunger being axially displaced by the fuel fed into the injection pump chamber, through a stroke in proportion to the amount of the fed fuel, a first stop on one end of the injection cylinder adjacent to the delivery cylinder for limiting the axial movement of the injection plunger in one direction, a second stop on the other end of the injection cylinder for limiting the axial movement of the injection plunger in the opposite direction, fuel passage means for feeding the fuel into the injection pump chamber, and nozzle means for injecting the fuel delivered by the injection pump chamber, said injection plunger being moved under the pressure which occurs in the delivery pump chamber due to the displacement of the delivery plunger to deliver the fuel in the injection pump chamber into the nozzle means, said two stops comprising axially extending projections which are adapted to control the axial displacement of the injection plunger.

2. A fuel injection system according to claim 1, further comprising a fuel control valve means in the fuel passage means for controlling the amount of fuel passing therethrough to be fed into the injection pump chamber.

3. A fuel injection system according to claim 1 or 2, further comprising nozzle holder means for holding said nozzle means.

4. A fuel injection system according to claim 3, wherein said nozzle holder means is rigidly connected to the injection cylinder.

5. A fuel injection system according to claim 1 or 2, wherein said axially extending projections of the stops define damper spaces therearound in the injection cylinder to damp the axial movement of the injection plunger.

* * * * *